US006827836B2

(12) United States Patent
Soloveichik

(10) Patent No.: US 6,827,836 B2
(45) Date of Patent: Dec. 7, 2004

(54) METHOD OF PREPARING BROMINATED HYDROXY AROMATIC COMPOUNDS

(75) Inventor: Grigorii Lev Soloveichik, Latham, NY (US)

(73) Assignee: General Electric Company, Niskayuna, NY (US)

( * ) Notice: Subject to any disclaimer, the term of this patent is extended or adjusted under 35 U.S.C. 154(b) by 196 days.

(21) Appl. No.: 10/307,587

(22) Filed: Dec. 2, 2002

(65) Prior Publication Data

US 2004/0104126 A1 Jun. 3, 2004

(51) Int. Cl.[7] ..... C25B 3/00; C25B 3/02
(52) U.S. Cl. ..... 205/453; 205/450; 205/452
(58) Field of Search ..... 205/450, 452, 205/453

(56) References Cited

FOREIGN PATENT DOCUMENTS

DE 26 13 969 A1 * 10/1977

OTHER PUBLICATIONS

Bejerano et al., "The Use of Adsorbed Bromine as a Brominating Agent in Organic Reaction—The Production of Mono and Dibrompenols", Electrochimica Acta, vol. 21 (no month, 1976), pp. 231–237.*

Landsberg et al., "Effect of Potential on the Composition of the Products of Electrochemical Bromination of Phenol", Wissenschaftliche Zeitschrift der Technischen Hochschule fuer Chemie "Carl Schloriemmer" Leuna–Merseburg, vol. 2 (no month, 1959), p. 461.*

Electrochemica Acta, 1976, vol. 21, p231, nomonth.

* cited by examiner

*Primary Examiner*—Edna Wong
(74) *Attorney, Agent, or Firm*—Andrew J. Caruso; Patrick K. Patnode

(57) ABSTRACT

Direct bromination of hydroxy aromatic compounds by electrolysis of mixtures comprising the hydroxy aromatic compound, a source of bromide ion, and an organic solvent provides product brominated hydroxy aromatic compounds at synthetically useful rates with high para-selectivity. The process does not require the use or handling of molecular bromine or bromine complexes and allows the full use of the bromide source without generating hydrogen bromide as a by-product of the reaction. The simple electrochemical equipment required by the present process, for example an undivided electrochemical cell, makes the process less capital intensive than analogous electrochemical processes carried out in divided cells. The use of hydrobromic acid as the source of bromide ion provides clean reaction with nearly exclusive formation of the target brominated product.

30 Claims, No Drawings

METHOD OF PREPARING BROMINATED HYDROXY AROMATIC COMPOUNDS

BACKGROUND OF THE INVENTION

This invention relates to an electrochemical method for the bromination of hydroxy aromatic compounds. More particularly the present invention provides a method for the preparation of brominated phenols such as para-bromophenol.

Brominated hydroxy aromatic compounds such as para-bromophenol are valuable intermediates for production of bisphenols such as 4,4'-biphenol and hydroquinone. 4,4'-biphenol may be prepared by coupling para-bromophenol, and hydroquinone may be prepared by hydrolysis of para-bromophenol. In addition, brominated phenols are versatile intermediates in the preparation of organic dyestuffs, and as synthons for agricultural chemicals used for plant protection. It is known that molecular bromine, $Br_2$, reacts readily with phenol to form predominantly bromophenol. However, although the reaction rate is high, the selectivity of the reaction is relatively poor, para/ortho selectivity of only about 75% being typical. In addition, significant amounts of the "over-brominated" product, 2,4-dibromophenol, are formed. It should be noted as well that the use and handling of molecular bromine, a volatile, toxic liquid at room temperature, poses significant engineering challenges to prevent its adventitious release into the environment, as well as human health concerns related to the acute toxicity of molecular bromine.

Various attempts have been made to improve selectivity in the bromination of phenol with molecular bromine, and in some aspects these efforts have been successful. Thus, the use of tetraalkylammonium salts of the $Br_3^-$anion afforded improved selectivity during the bromination of phenol. However, the improved selectivity came at the expense of low reaction rates. Moreover, the tetraalkylammonium bromides are costly and must be recovered and recycled. Other salts of the tribromide anion ($Br_3^-$) have also been used for bromination reactions of phenol. Complexes of molecular bromine with alkylsulfides have demonstrated good selectivity for para-bromination of phenol but possess many of the same disadvantages as the organic salts of tribromide anion. Other schemes to improve selectivity in bromination reactions of phenol have employed combinations of molecular bromine with silica, and molecular bromine and cyclodextrin. Here again, however, selectivity was insufficient. Moreover, bromination reactions based upon molecular bromine or its complexes use only half of the bromine introduced and produce a full equivalent of hydrogen bromide, HBr, as a by-product. To date, the highest selectivity observed in the bromination of phenol was achieved by reaction of phenol with a brominating agent based upon a combination of HBr, molecular oxygen, and a heteropolyacid catalyst. Despite the high selectivity observed (99%) in the bromination of phenol, the process suffers from low catalyst turnover, the high molecular weight of the catalyst, and the high cost of the catalyst.

Some years ago, it was reported that the electrolysis of aqueous solutions of phenol in the presence of a bromide salt as the electrolyte afforded predominantly para-bromophenol (T.Bejerano, E.Gileadi, Electrochimica Acta, 1976, vol. 21, p. 231). The method disclosed only very low concentrations of reactants suggesting that such a method was unlikely to be useful for the preparation of substantial amounts of bromophenol product. Moreover, the low para/ortho selectivity observed cast doubt upon the method's viability in as a modern industrial practice.

It is clear from the foregoing discussion that new processes which are not dependent upon the use of molecular bromine for the preparation of brominated hydroxy aromatic compounds such as bromophenol represent very attractive goals, especially if the new processes are both highly selective and efficient. The present invention provides a new, highly selective and highly efficient electrochemical method for the preparation of brominated hydroxy aromatic compounds. The new method does not require the use of molecular bromine.

BRIEF SUMMARY OF THE INVENTION

In one aspect the present invention relates to a method for the preparation of brominated hydroxy aromatic compounds, said method comprising: electrolyzing in an electrochemical cell a mixture comprising a hydroxy aromatic compound, at least one source of bromide ion, at least one organic solvent, and optionally water, to provide a product brominated hydroxy aromatic compound.

In another aspect the present invention provides an electrochemical method for the preparation of bromophenols such as para-bromophenol and 4-bromo-2-methylphenol. In yet another aspect the method of the present invention comprises recovering the product brominated hydroxy aromatic compound from a product mixture.

DETAILED DESCRIPTION OF THE INVENTION

The present invention may be understood more readily by reference to the following detailed description of preferred embodiments of the invention and the examples included therein. In the following specification and the claims which follow, reference will be made to a number of terms which shall be defined to have the following meanings:

The singular forms "a", "an" and "the" include plural referents unless the context clearly dictates otherwise.

"Optional" or "optionally" means that the subsequently described event or circumstance may or may not occur, and that the description includes instances where the event occurs and instances where it does not.

As used herein the term "aliphatic radical" refers to a radical having a valence of at least one comprising a linear or branched array of atoms which is not cyclic. The array may include heteroatoms such as nitrogen, sulfur and oxygen or may be composed exclusively of carbon and hydrogen. Examples of aliphatic radicals include methyl, methylene, ethyl, ethylene, hexyl, hexamethylene and the like.

As used herein the term "aromatic radical" refers to a radical having a valence of at least one comprising at least one aromatic group. Examples of aromatic radicals include phenyl, pyridyl, furanyl, thienyl, naphthyl, phenylene, and biphenyl. The term includes groups containing both aromatic and aliphatic components, for example a benzyl group.

As used herein the term "cycloaliphatic radical" refers to a radical having a valance of at least one comprising an array of atoms which is cyclic but which is not aromatic. The array may include heteroatoms such as nitrogen, sulfur and oxygen or may be composed exclusively of carbon and hydrogen. Examples of cycloaliphatic radicals include cyclopropyl, cyclopentyl cyclohexyl, tetrahydrofuranyl and the like.

As used herein the term "over-bromination" refers to the substitution of more than one hydrogen atom in a hydroxy aromatic compound by bromine atoms. Over-bromination is illustrated by the transformation of phenol into 2,4-dibromophenol which entails the substitution of two hydrogen atoms in the starting hydroxy aromatic compound, phenol, by bromine atoms.

As used herein the term "hydrobromic acid" is interchangeable with the term "aqueous hydrogen bromide" and means a mixture of hydrogen bromide (HBr) and water.

It has been discovered that electrolysis of relatively concentrated mixtures comprising a hydroxy aromatic compound, a source of bromide ion, and an organic solvent results in relatively efficient bromination of the hydroxy aromatic compound. For example, it was found that when a mixture of phenol, hydrobromic acid, and acetonitrile was subjected to electrolysis in an electrochemical cell, the product produced was predominantly p-bromophenol. Overall, the process is illustrated by the phenol to para-bromophenol transformation represented by equation (1).

$$C_6H_5OH+HBr \rightarrow BrC_6H_4OH+H_2 \quad (1)$$

Electrosynthesis of brominated hydroxy aromatic compounds according to the method of the present invention may be carried out conveniently in an electrochemical cell. The electrochemical cell may be either a divided or an undivided cell. Frequently the use of an undivided electrochemical is preferred since sufficiently high current efficiencies (>95%) may be achieved in undivided cells when used according to the method of the present invention. The electrochemical cells may comprise almost any type of electrodes although the use of graphite electrodes is preferred. In one embodiment of the present invention the anode of the electrochemical cell employed consists of a graphite electrode, and the cathode consists of another suitable material which is not graphite. Typically, the electrochemical cell used according to the method of the present invention is operated at a current density in a range between about 20 and about 1000 milliamperes per square centimeter ($mA/cm^2$), preferably between about 50 and about 400 $mA/cm^2$, and even more preferably between about 100 and about 250 $mA/cm^2$. Typically, the cell is operated at a cell voltage higher than about 1.5 volts (V), preferentially in a range between about 3 and about 4 V.

As mentioned, the method of the present invention comprises electrolyzing in an electrochemical cell a mixture comprising a hydroxy aromatic compound, at least one source of bromide ion, and at least one organic solvent. Typically the hydroxy aromatic compound is used in an amount corresponding to greater than 5 percent of the entire weight of the mixture undergoing electrolysis. In one embodiment the hydroxy aromatic compound is used in an amount corresponding to between 5 percent and about 50 percent of the entire weight of the mixture undergoing electrolysis. Under such circumstances, the concentration of the hydroxy aromatic compound is defined as being between 5 and about 50 percent by weight of the mixture. In an alternate embodiment the hydroxy aromatic compound is used in an amount corresponding to between about 10 percent and about 40 percent of the entire weight of the mixture undergoing electrolysis. Suitable hydroxy aromatic compounds which may be used according to the method of the present invention include monofunctional phenols having structure I

I

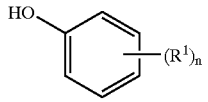

wherein $R^1$ is independently at each occurrence a halogen atom, a $C_1$–$C_{20}$ aliphatic radical, a $C_4$–$C_{20}$ aromatic radical, or a $C_3$–$C_{20}$ cycloaliphatic radical, and n is an integer having a value of from 0 to 4.

Monofunctional phenols having structure I are illustrated by phenol, ortho-cresol (2-methylphenol), 2-chlorophenol, 2-tert-butylphenol, 2-phenylphenol, 2-isopropyl-5-methylphenol, and the like.

In addition to monofunctional phenols having structure I, suitable hydroxy aromatic compounds which may be used according to the method of the present invention include hydroxynaphthalenes having structure II

II

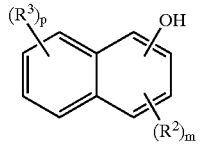

wherein $R^2$ and $R^3$ are independently at each occurrence a halogen atom, $C_1$–$C_{20}$ aliphatic radical, a $C_4$–$C_{20}$ aromatic radical, or a $C_3$–$C_{20}$ cycloaliphatic radical, m is an integer from 0 to 2, and p is an integer from 0 to 4.

Hydroxynaphthalenes having structure II are illustrated by 1-naphthol, 2-naphthol, 2-methyl-1-naphthol, 2-chloro-1-naphthol, 2-tert-butyl-1-naphthol, and the like.

The source of bromide ion used according to the method of the present invention may be any bromine containing compound which furnishes ionic bromide ion under the conditions present in the electrochemical cell. Thus, suitable sources of bromide ion include hydrobromic acid, alkali metal bromides, transition metal bromides, quaternary ammonium bromides, amine hydrobromides, quaternary phosphonium bromides, and the like. In one embodiment of the present invention the source of bromide ion is a solution of 48 percent by weight hydrobromic acid in water. In an alternate embodiment the source of bromide ion is a mixture of sodium bromide and hydrobromic acid. Many different combinations of bromide ion sources may be used advantageously according to the method of the present invention. In some embodiments at least one transition metal bromide in addition to a non-transition metal bromide source such as hydrobromic acid is present in the reaction mixture undergoing electrolysis. In another embodiment, at least one quaternary ammonium bromide or quaternary phosphonium bromide in addition to a bromide source such as hydrobromic acid which is neither a quaternary ammonium or quaternary phosphonium bromide is present in the reaction mixture undergoing electrolysis. Regardless of the source of the bromide ion, it has been found that in instances in which the molar ratio of the hydroxy aromatic compound to bromide ion from any source is less than about 1 the reaction shows greater selectivity for monobromination and "over-bromination" is avoided.

Transition metal bromides which may be advantageously employed according to the method of the present invention include $CuBr_2$, $FeBr_2$, $ZnBr_2$, and $CoBr_2$. In some instances it may be advantageous to employ mixtures of transition metal bromides. Quaternary ammonium bromides are illustrated by tetrabutylammonium bromide, tetraethylammonium bromide, tetramethylammonium bromide, and the like. Amine hydrobromides are illustrated by triethylamine hydrobromide, diethylamine hydrobromide, trimethylamine hydrobromide, ammonium bromide, and the like. Quaternary phosphonium bromides are illustrated by tetrbutylphosphonium bromide, tetramethylphosphonium bromide, and the like.

In some embodiments the source of bromide ion employed comprises hydrobromic acid generated by combining an acid with an alkali metal bromide, for example a combination of sodium bromide and aqueous sulfuric acid. The combination of sodium bromide and aqueous sulfuric acid is shown herein to be suitable source of bromide ion for use according to the method of the present invention.

Organic solvents suitable for use according to the method of the present invention include nitrites, esters, alcohols, esters, amides, ketones, and ethers. Typically nitrites such as acetonitrile are preferred. Suitable solvents include acetonitrile, propionitrile, tetrahydrofuran, N,N-dimethylformamide, 1-methyl-2-pyrrolidinone, diglyme, tetraglyme, ethanol, and methanol. In some instances the organic solvent employed may affect the selectivity of the bromination reaction.

In embodiments in which the mixture being electrolyzed contains water, as when, for example, the source of bromide ion comprises hydrobromic acid, the choice of solvent made may affect the homogeneity or heterogeneity of the mixture. Thus the mixture undergoing electrolysis according to the method of the present invention may be a single phase system or a multiphase system. An example of a multiphase system is a mixture of phenol, aqueous HBr, and propionitrile. An example of a single phase system is a mixture of phenol, aqueous HBr, sodium bromide, and methanol.

The method of the present invention may be practiced as a continuous process or a batch-type process. In continuous embodiments of the present invention the electrochemical cell employed is comprised within a flow reactor. Thus a mixture comprising a hydroxy aromatic compound, a source of bromide ion, and an organic solvent are continuously introduced into a flow reactor comprising at least one electrochemical cell, and an effluent stream containing product brominated hydroxy aromatic compound is continuously removed from the flow reactor. The flow reactor may simply be the electrochemical cell itself, or two or more electrochemical cells arranged in series, or two or electrochemical cells arranged in parallel, or three or more electrochemical cells arrayed in a network arrangement. A network arrangement of electrochemical cells comprises cells arrayed in at least one parallel arrangement, and at least one series arrangement. In one embodiment, the electrochemical cell (or cells) is a bipolar electrochemical cell. In an alternate embodiment the flow reactor comprises a series of stirred tank reactors each of said stirred tank reactors comprising an electrochemical cell. Typically, it is preferred that the flow reactor consist of one or more "flow" electrochemical cells. In yet another embodiment the product brominated hydroxy aromatic compound is continuously isolated by precipitation into water and filtration on a continuous rotary filtration device such as a Bird-Young rotary vacuum filter.

In embodiments of the present invention which are batch-type processes the electrochemical cell is comprised within a batch reactor. The batch reactor may be the electrochemical cell itself or alternatively the electrochemical cell may be a component of the batch reactor, for example as where the electrochemical cell is contained within a circulating loop of a stirred tank reactor. In one embodiment the electrochemical cell is a bipolar electrochemical cell. As in the continuous embodiments, the product brominated hydroxy aromatic compound may be isolated by dilution into water followed by filtration. Alternatively, the product may be isolated by standard methods such as dilution with a water immiscible solvent, washing the resultant organic phase with water, drying and evaporating to afford a crude brominated hydroxyaromatic compound which is then purified at need by crystallization, distillation, or like method.

The product brominated hydroxy aromatic compound may be a brominated phenol having structure III

III

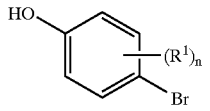

wherein $R^1$ and n are defined as in structure I.

Brominated hydroxy aromatic compounds having structure III are exemplified by 4-bromo-2-chlorophenol, 4-bromo-2-methyphenol, 4-bromo-2-tert-butylphenol, and para-bromophenol.

Alternatively the product brominated hydroxy aromatic compound may be a bromonaphthol having structure IV

IV

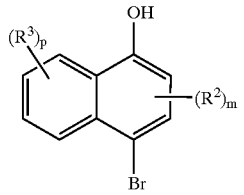

wherein $R^2$, $R^3$, m, and p are defined as in structure II.

Bromonaphthols having structure IV are exemplified by 4-bromo-1-naphthol, 4-bromo-2-chloro-1-naphthol, 4-bromo-2-methyl-1-naphthol, and 4-bromo-2-tert-butyl-1-naphthol.

In one embodiment the present invention provides a method for the preparation of a brominated hydroxy aromatic compound having structure III, said method comprising:

(A) electrolyzing in an electrochemical cell a mixture comprising a hydroxy aromatic compound having structure I, aqueous hydrogen bromide, and at least one organic solvent; and (B) recovering the product brominated hydroxy aromatic compound.

In another embodiment the present invention provides a method for the preparation of para-bromophenol, said method comprising:

(A) electrolyzing in an electrochemical cell a mixture comprising phenol, hydrobromic acid, and acetonitrile, said phenol and aqueous hydrogen bromide being present in amounts corresponding to a molar ratio of phenol to hydrogen bromide in a range between about 0.6 to 1 and about 1.0 to 1, said electrochemical cell being operated at a current density in a range between about 20 and about 1000 milliamperes per square centimeter; and (B) recovering a product para-bromophenol.

In yet another embodiment the present invention provides a method for the preparation 4-bromo-2-methylphenol, said method comprising:

(A) electrolyzing in an electrochemical cell a mixture comprising ortho-cresol, hydrobromic acid, and acetonitrile, said ortho-cresol and aqueous hydrogen bromide being present in amounts corresponding to a molar ratio of ortho-cresol to hydrogen bromide in a range between about 0.6 to 1 and about 1.0 to 1, said electrochemical cell being operated at a current density in a range between about 20 and about 1000 milliamperes per square centimeter; and (B) recovering a product 4-bromo-2-methylphenol.

EXAMPLES

The following examples are set forth to provide those of ordinary skill in the art with a detailed description of how the methods claimed herein are evaluated, and are not intended to limit the scope of what the inventors regard as their invention. Unless indicated otherwise, parts are by weight, temperature is in ° C. Product mixtures were analyzed by quantitative HPLC and the percent of starting phenol converted to product was determined (See "% Phenol Convers." in Tables 1–3). Product selectivities were likewise determined by quantitative HPLC. Two measurements of product selectivity were made: (i) "para-selectivity" which is defined here as the amount of para-bromophenol relative to the total amount of all brominated products present in the product mixture, and (ii) "mono-selectivity" which is defined as the total peak amount of all mono-brominated products relative to the total amount of all brominated products present in the product mixture. Reaction rates expressed in moles of product per liter per hour represent the average reaction rate and are obtained by dividing the number of moles of phenol converted to product by the volume of the reaction mixture and the reaction time. The column heading "Br/PhOH" in Tables 1–3 is a molar ratio and refers to the total number of moles of bromide ion from all sources present in the reaction mixture divided by the number of moles of phenol initially present in the reaction mixture.

Examples 1–14

Example 1: A glass electrochemical cell equipped with graphite electrodes (area 2.5 $cm^2$ was charged with 3.544 grams of phenol (PhOH), 4.717 grams of hydrobromic acid (48% by weight HBr) and 9.746 grams acetonitrile (MeCN). Bulk electrolysis was carried out at 3 V constant potential using a CHI-110 potentiostat over a period of 5.5 hours. The product mixture was analyzed by HPLC.

Examples 2–14 were carried in a similar fashion using the same electrochemical cell but operated at 4 V constant potential. Data for Examples 1–14 are gathered in Table 1. In Example 11 the aqueous HBr was generated from a solution of sodium bromide in aqueous sulfuric acid. In Table 1 the column headings "para %" and "mono %" refer to the "para-selectivity" and "mono-selectivity" measured for each reaction.

TABLE 1

ELECTROCHEMICAL BROMINATION OF PHENOL USING HYDROBROMIC ACID AS THE SOLE BROMIDE SOURCE

| Example | PhOH (grams) | HBr (grams) | MeCN (grams) | Br/ PhOH | Rxn time, hr | % Phenol Convs. | Rate, mol/Lhr | Para % | mono % |
|---|---|---|---|---|---|---|---|---|---|
| 1 | 2.41 | 3.22 | 8.88 | 0.75 | 2 | 29.6 | 0.24 | 90.8 | 100 |
| 2 | 2.41 | 4.31 | 8.35 | 1.00 | 2 | 42.1 | 0.34 | 88.5 | 100 |
| 3 | 4.86 | 6.53 | 5.37 | 0.75 | 2 | 23.1 | 0.38 | 90.1 | 100 |
| 4 | 4.85 | 7.61 | 4.83 | 0.88 | 2 | 29.2 | 0.48 | 90.2 | 100 |
| 5 | 2.55 | 4.4 | 10.05 | 0.96 | 3.6 | 76.3 | 0.32 | 89.1 | 100 |
| 6 | 2.55 | 4.24 | 10.23 | 0.93 | 3.6 | 72.8 | 0.3 | 89.6 | 100 |
| 7 | 3.35 | 5.65 | 7.99 | 0.94 | 3.6 | 37.6 | 0.22 | 91.1 | 100 |
| 8 | 4.11 | 7.09 | 5.81 | 0.96 | 3.6 | 47 | 0.36 | 90 | 98.5 |
| 9 | 3 | 4.5 | 9.43 | 0.84 | 4 | 64.4 | 0.29 | 88.6 | 100 |
| 10 | 3.54 | 4.72 | 9.75 | 0.74 | 6 | 50.6 | 0.17 | 88.2 | 100 |
| 11 | 3.05 | 3.28 | 10.78 | 0.6 | 6 | 33.5 | 0.1 | 89.4 | 100 |
| 12 | 3.24 | 4.44 | 11.09 | 0.77 | 6 | 27.3 | 0.08 | 93.5 | 100 |
| 13 | 1.7 | 2.79 | 12.5 | 0.92 | 7 | 86.6 | 0.12 | 88.9 | 97.4 |
| 14 | 3.38 | 5.86 | 7.75 | 0.97 | 7 | 63.4 | 0.19 | 89.1 | 96.4 |

Examples 15–29

Example 15: A glass electrochemical cell equipped with graphite electrodes (area 2.5 $cm^2$ was charged with 3.26 grams of phenol, 4.00 grams of sodium bromide (NaBr) and 10.4 grams of acetonitrile (MeCN). Bulk electrolysis was carried out at 4 V constant potential over a period of 5.5 hours (hr). The product mixture was analyzed by HPLC.

Examples 16–29 were carried out in a similar fashion using the same electrochemical cell operated at 4 V constant potential. Data for Examples 15–29 are gathered in Table 2. In Table 2 the column heading "Br Source" identifies a source of bromide in addition to sodium bromide and aqueous HBr which were used in the reaction. The column heading "Wt Br Source" indicates the weight in grams of the additional bromide source used. Examples 28 and 29 are included in Table 2 as a space-saving measure. In Examples 28 and 29 no source of bromide in addition to sodium bromide and HBr was employed. Instead, the reaction mixtures included 0.11 grams of nickel acetate and 0.13 grams of cerium chloride respectively.

TABLE 2

ELECTROCHEMICAL BROMINATION OF PHENOL INCLUDING SODIUM BRMIDE AS THE BROMIDE SOURCE

| Example | PhOH (grams) | NaBr (grams) | HBr (grams) | Br Source | Wt Br Source | Solvent | MeCN (grams) |
|---|---|---|---|---|---|---|---|
| 15 | 3.26 | 4 | — | — | — | MeCN | 10.4 |
| 16 | 4.17 | 3.4 | 1.71 | — | — | MeCN | 7.8 |
| 17 | 5.1 | 3.4 | 3.4 | — | — | MeCN | 5.1 |
| 18 | 8.93 | 10.02 | 6.89 | — | — | MeCN | 28.2 |
| 19 | 9.72 | 5.03 | 5.79 | — | — | MeCN | 31.6 |
| 20 | 5.68 | 0.8 | — | CuBr2 | 0.2 | tetraglyme | 9.9 |
| 21 | 4.68 | 1.04 | — | CuBr2 | 0.12 | DMF | 11.8 |
| 22 | 4.33 | 1.07 | — | CuBr2 | 0.07 | DMAA | 12.7 |
| 23 | 4.76 | 1.05 | — | CuBr2 | 0.08 | MeOH | 13.1 |
| 24 | 3.82 | 1.04 | 3.83 | CuBr2 | 0.06 | MeOH | 10.6 |
| 25 | 2.79 | 1.03 | 1.68 | CuBr2 | 0.11 | MeCN | 11.3 |
| 26 | 8.53 | 5.12 | 5.8 | CuBr2 | 0.2 | MeCN | 31.3 |
| 27 | 3.81 | 1 | — | FeBr2 | 0.17 | MeCN | 10.8 |
| 28 | 2.93 | 1.07 | 1.94 | NiOAc2 | 0.11 | MeCN | 11.1 |
| 29 | 3.04 | 1.01 | 1.31 | CeCl3 | 0.13 | MeCN | 10.6 |

| Example | Br/ PhOH | Voltage (V) | Rxn time hr | % Phenol Convs. | Rate, mol/L hr | para-selectivity % | Mono selectivity % |
|---|---|---|---|---|---|---|---|
| 15 | 0.96 | 4 | 5.5 | 3.2 | 0.012 | 100 | 100 |
| 16 | 0.97 | 4 | 5.5 | 29.8 | 0.161 | 90.4 | 100 |
| 17 | 0.98 | 4 | 5.5 | 38.8 | 0.282 | 90.4 | 100 |
| 18 | 1.46 | 5 | 5.8 | 32.8 | 0.111 | 92.8 | 97.1 |
| 19 | 0.81 | 6 | 6 | 33.3 | 0.108 | 91.8 | 100 |
| 20 | 0.16 | 2 | 2 | 3.3 | 0.055 | 100 | 100 |
| 21 | 0.23 | 2 | 6 | 11 | 0.047 | 63.7 | 96.4 |
| 22 | 0.24 | 2 | 6 | 10 | 0.038 | 83.3 | 90 |
| 23 | 0.21 | 4 | 3.8 | 13.9 | 0.087 | 82.2 | 96.1 |
| 24 | 0.82 | 4 | 4 | 16.8 | 0.087 | 80.1 | 92.9 |
| 25 | 0.71 | 4 | 1.2 | 34.5 | 0.47 | 93.2 | 100 |
| 26 | 0.95 | 4 | 3.6 | 41.7 | 0.203 | 92.8 | 100 |
| 27 | 0.28 | 4 | 6 | 12.4 | 0.048 | 100 | 100 |
| 28 | 0.7 | 4 | 3 | 32.9 | 0.188 | 88.9 | 100 |
| 29 | 0.54 | 4 | 7.5 | 22.3 | 0.056 | 92.5 | 100 |

The electrochemical brominations of Examples 30–38 were carried out as in Example 15 with the exception that bromide sources other than sodium bromide were employed. Data for Examples 30–38 are gathered in Table 3. In table 3 the column heading "Br Source" identifies bromide sources other than aqueous HBr present in the reaction mixture. The column heading "Wt Br Source" indicates the weight in grams of the bromide source other than aqueous HBr.

TABLE 3

ELECTROCHEMICAL BROMINATION OF PHENOL USING ALTERNATE BROMIDE SOURCES

| Example | PhOH (grams) | HBr (grams) | Br Source | Wt Br Source | MeCN (grams) | Br/ PhOH | Voltage (V) |
|---|---|---|---|---|---|---|---|
| 30 | 3.26 | 2.07 | CuBr2 | 1.19 | 11.03 | 0.66 | 5 |
| 31 | 3.26 | | CuBr2 | 1.19 | 11.03 | 0.31 | 5 |
| 32 | 3.28 | 1.43 | NEt4Br | 1.88 | 9.25 | 0.73 | 4 |
| 33 | 3.3 | 2 | FeBr2 | 1.01 | 12.5 | 0.6 | 4 |
| 34 | 2.6 | 1.44 | FeBr2 | 1.18 | 11.47 | 0.69 | 4 |
| 35 | 2.8 | | CuBr2 | 1.31 | 11.78 | 0.39 | 4 |
| 36 | 2.84 | 1.11 | ZnBr2 | 2.09 | 13 | 0.84 | 5 |
| 37 | 2.01 | | LiBr | 1.83 | 13.41 | 0.84 | 4 |

| Example | Rxn time hr | % Phenol Convs. | Rate, mol/L hr | para-selectivity % | mono-selectivity % |
|---|---|---|---|---|---|
| 30 | 6.5 | 55.1 | 0.23 | 95.4 | 97 |
| 31 | 1.9 | 20.8 | 0.16 | 100 | 100 |

TABLE 3-continued

ELECTROCHEMICAL BROMINATION OF PHENOL USING ALTERNATE BROMIDE SOURCES

| | | | | | |
|---|---|---|---|---|---|
| 32 | 4.3 | 27.4 | 0.14 | 89.4 | 100 |
| 33 | 2 | 12.4 | 0.11 | 100 | 100 |
| 34 | 6 | 9.8 | 0.02 | 100 | 100 |
| 35 | 4.6 | 35.5 | 0.13 | 96.3 | 100 |
| 36 | 4.3 | 33.8 | 0.12 | 90.4 | 96.4 |
| 37 | 3.5 | 29.4 | 0.1 | 72.6 | 84.4 |

Examples 38–41

Examples 38–41 involved the electrochemical bromination of ortho-cresol (Examples 38–40) and meta-cresol (Example 41). The electrochemical brominations of Examples 38–41 were carried out in a manner analogous to the procedure used in Example 1. Results are gathered in Table 4. As in Table 1, the column headings "para %" and "mono %" refer to the "para-selectivity" and "mono-selectivity" measured for each reaction. The column heading "Br/ArOH" in Tables 4 is a molar ratio and refers to the total number of moles of bromide ion from all sources present in the reaction mixture divided by the number of moles of o-cresol or m-cresol initially present in the reaction mixture. Data appearing in Table 4 under the column heading "% ArOH Convs." indicates the percentage of o-cresol or m-cresol converted to brominated products.

TABLE 4

ELECTROCHEMICAL BROMINATION OF O-CRESOL AND M-CRESOL USING HYDROBROMIC ACID AS THE SOLE BROMIDE SOURCE

| Example | cresol | cresol (grams) | HBr (grams) | MeCN (grams) | Br/ ArOH | Rxn time, hr | % ArOH Convs. | Rate, mol/Lhr | Para % | mono % |
|---|---|---|---|---|---|---|---|---|---|---|
| 38[1] | ortho | 3.83 | 5.74 | 9.60 | 0.80 | 4.8 | 59.2 | 0.21 | 98.3 | 100 |
| 39[2] | ortho | 2.41 | 4.31 | 8.35 | 1.00 | 2 | 42.1 | 0.34 | 88.5 | 100 |
| 40[3] | ortho | 4.86 | 6.53 | 5.37 | 0.75 | 2 | 23.1 | 0.38 | 90.1 | 100 |
| 41[2] | meta | 4.85 | 7.61 | 4.83 | 0.88 | 2 | 29.2 | 0.48 | 90.2 | 100 |

[1]Example 38: Cell voltage was 3 volts.
[2]Examples 39 and 41: Cell voltage was 4 volts.
[3]Example 40: Cell voltage was 5 volts.

The data in Tables 1–4 illustrate the versatility of the method of the present invention. The method is characterized by high selectivity for para bromination and control of unwanted over-bromination is demonstrated by the high values of mono-selectivity observed. The reaction can be run with a single source of bromide ion, such as aqueous HBr (Examples 1–14 and 38–41). Alternatively, the reaction can be run with multiple sources of bromide ion, for example mixtures of sodium bromide, aqueous HBr and copper bromide as employed in Examples 24–26. The method of the present invention may even be carried out under anhydrous conditions (See Examples 15 and 20–23) albeit the reaction rates were generally reduced relative to reaction rates observed when aqueous bromide ion was present. Quaternary ammonium bromides may advantageously be employed as a source of additional bromide ion (See Example 33). In addition, the data demonstrate that method of the present invention permits the highly selective electrochemical bromination of o-cresol (Examples 38–40) as well as m-cresol (Example 41).

The invention has been described in detail with particular reference to preferred embodiments thereof, but it will be understood by those skilled in the art that variations and modifications can be effected within the spirit and scope of the invention.

What is claimed is:

1. A method for the preparation of a brominated hydroxy aromatic compound, said method comprising: electrolyzing in an electrochemical cell a mixture comprising a hydroxy aromatic compound, at least one source of bromide ion, at least one organic solvent, and optionally water, to afford a product brominated hydroxy aromatic compound.

2. A method according to claim 1 wherein said electrochemical cell is operated at a current density in a range between about 20 and about 1000 milliamperes per square centimeter.

3. A method according to claim 1 wherein said electrochemical cell comprises a graphite anode.

4. A method according to claim 1 wherein said hydroxy aromatic compound is selected from the group consisting of monofunctional phenols having structure I

I

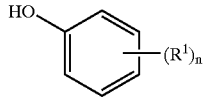

wherein $R^1$ is independently at each occurrence a halogen atom, a $C_1$–$C_{20}$ aliphatic radical, a $C_4$–$C_{20}$ aromatic radical, or a $C_3$–$C_{20}$ cycloaliphatic radical, and n is an integer having a value of from 0 to 4, and hydroxynaphthalenes having structure II

II

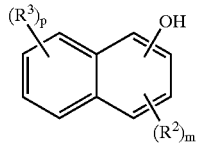

wherein $R^2$ and $R^3$ are independently at each occurrence a halogen atom, $C_1$–$C_{20}$ aliphatic radical, a $C_4$–$C_{20}$ aromatic radical, or a $C_3$–$C_{20}$ cycloaliphatic radical, m is an integer from 0 to 2, and p is an integer from 0 to 4.

5. A method according to claim 4 wherein said hydroxy aromatic compound is phenol.

6. A method according to claim 4 wherein said hydroxy aromatic compound is ortho-cresol.

7. A method according to claim 1 wherein said source of bromide ion comprises hydrobromic acid.

8. A method according to claim 7 wherein said source of bromide ion further comprises an alkali metal bromide.

9. A method according to claim 8 wherein said alkali metal bromide is sodium bromide.

10. A method according to claim 9 wherein said source of bromide further comprises at least one transition metal bromide.

11. A method according to claim 10 wherein said transition metal bromide is selected from the group consisting of $CuBr_2$, $FeBr_2$, $ZnBr_2$, and $CoBr_2$.

12. A method according to claim 7 wherein said source of bromide ion further comprises at least one quaternary ammonium bromide.

13. A method according to claim 1 wherein said source of bromide ion comprises an alkali metal bromide.

14. A method according to claim 13 wherein said alkali metal bromide is sodium bromide.

15. A method according to claim 1 wherein said organic solvent is selected from the group consisting of nitriles, esters, alcohols, esters, amides, ketones, and ethers.

16. A method according to claim 15 wherein said solvent is selected from the group consisting of acetonitrile, propionitrile, tetrahydrofuran, N,N-dimethylformamide, 1-methyl-2-pyrrolidinone, diglyme, tetraglyme, ethanol, and methanol.

17. A method according to claim 1 wherein said electrochemical cell is comprised within a flow reactor.

18. A method according to claim 1 wherein said electrochemical cell is comprised within a batch reactor.

19. A method according to claim 1 wherein the product brominated hydroxy aromatic compound has structure III

III

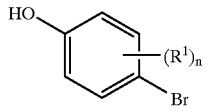

wherein $R^1$ is independently at each occurrence a halogen atom, a $C_1$–$C_{20}$ aliphatic radical, a $C_4$–$C_{20}$ aromatic radical, or a $C_3$–$C_{20}$ cycloaliphatic radical, and n is an integer having a value of from 0 to 4.

20. A method according to claim 19 wherein the product brominated hydroxy aromatic compound having structure III is selected from the group consisting of 4-bromo-2-chlorophenol, 4-bromo-2-methyphenol, 4-bromo-2-tert-butylphenol, and para-bromophenol.

21. A method according to claim 1 wherein said product brominated hydroxy aromatic compound is a bromonaphthol having structure IV

IV

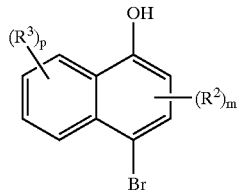

wherein $R^2$ and R are independently at each occurrence a halogen atom, $C_1$–$C_{20}$ aliphatic radical, a $C_4$–$C_{20}$ aromatic radical, or a $C_3$–$C_{20}$ cycloaliphatic radical, m is an integer from 0 to 2, and p is an integer from 0 to 4.

22. A method according to claim 21 wherein said bromonaphthol having structure IV is selected from the group consisting of 4-bromo-1-naphthol, 4-bromo-2-chloro-1-naphthol, 4-bromo-2-methyl-1-naphthol, and 4-bromo-2-tert-butyl-1-naphthol.

23. A method according to claim 1 wherein the product brominated hydroxy aromatic compound is produced with a para-selectivity of from about 85 to about 100 percent.

24. A method according to claim 1 wherein the product brominated hydroxy aromatic compound is produced with a mono-selectivity of from about 95 to about 100 percent.

25. A method according to claim 1 further comprising a product recovery step, said step comprising recovering the product brominated hydroxy aromatic compound from a product mixture.

26. A method according to claim 25 wherein said recovering the product brominated hydroxy aromatic compound comprises dilution of a product mixture with water and filtration of said product brominated hydroxy aromatic compound.

27. A method for the preparation of a brominated hydroxy aromatic compound having structure III

III

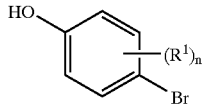

wherein $R^1$ is independently at each occurrence a halogen atom, a $C_1$–$C_{20}$ aliphatic radical, a $C_4$–$C_{20}$ aromatic radical, or a $C_3$–$C_{20}$ cycloaliphatic radical, and n is an integer having a value of from 0 to 4, said method comprising:

(A) electrolyzing in an electrochemical cell a mixture comprising a hydroxy aromatic compound having structure I

I

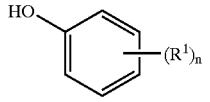

wherein $R^1$ is independently at each occurrence a halogen atom, a $C_1$–$C_{20}$ aliphatic radical, a $C_4$–$C_{20}$ aromatic radical, or a $C_3$–$C_{20}$ cycloaliphatic radical, and n is an integer having a value of from 0 to 4, aqueous hydrogen bromide, and at least one organic solvent; and (B) recovering the product brominated hydroxy aromatic compound.

28. A method according to claim 26 wherein said electrochemical cell is operated at a current density in a range between about 20 and about 1000 milliamperes per square centimeter.

29. A method for the preparation of para-bromophenol, said method comprising:

(A) electrolyzing in an electrochemical cell a mixture comprising phenol, hydrobromic acid, and acetonitrile, said phenol and hydrobromic acid being present in amounts corresponding to a molar ratio of phenol to hydrogen bromide in a range between about 0.6 to 1 and about 1.0 to 1, said electrochemical cell being operated at a current density in a range between about 20 and about 1000 milliamperes per square centimeter; and (B) recovering a product para-bromophenol.

30. A method for the preparation of 4-bromo-2-methylphenol, said method comprising:

(A) electrolyzing in an electrochemical cell a mixture comprising ortho-cresol, hydrobromic acid, and acetonitrile, said ortho-cresol and hydrobromic acid being present in amounts corresponding to a molar ratio of ortho-cresol to hydrogen bromide in a range between about 0.6 to 1 and about 1.0 to 1, said electrochemical cell being operated at a current density in a range between about 20 and about 1000 milliamperes per square centimeter; and (B) recovering a product 4-bromo-2-methylphenol.

* * * * *